US006733098B1

(12) United States Patent
Branson

(10) Patent No.: US 6,733,098 B1
(45) Date of Patent: May 11, 2004

(54) BRACKET AND METHOD FOR CONVERTING SIDE MOUNT DRAWER TO UNDER MOUNT DRAWER

(75) Inventor: Charles E. Branson, Thomasville, NC (US)

(73) Assignee: Hughes Supply Co. of Thomasville, Inc., Thomasville, NC (US)

( * ) Notice: Subject to any disclaimer, the term of this patent is extended or adjusted under 35 U.S.C. 154(b) by 0 days.

(21) Appl. No.: 10/224,127

(22) Filed: Aug. 20, 2002

(51) Int. Cl.[7] ..... A47B 97/00
(52) U.S. Cl. ..... 312/352
(58) Field of Search ..... 312/352, 330.1, 312/334.1, 334.4, 334.5, 334.6, 334.27, 334.32

(56) References Cited

U.S. PATENT DOCUMENTS

| | | | | |
|---|---|---|---|---|
| 3,658,399 A | | 4/1972 | Vogt | |
| 3,675,883 A | | 7/1972 | Holmes et al. | |
| 3,750,993 A | | 8/1973 | Read | |
| 4,176,890 A | | 12/1979 | Gorton | |
| 4,244,546 A | | 1/1981 | Mertes et al. | |
| 4,278,309 A | | 7/1981 | Dreiling | |
| 4,927,216 A | | 5/1990 | Boda | |
| 5,039,181 A | | 8/1991 | Lautenschlager | |
| 5,257,861 A | * | 11/1993 | Domenig et al. | 312/334.5 |
| 5,349,723 A | | 9/1994 | Domenig | |
| 5,549,376 A | * | 8/1996 | Domenig | 312/334.5 |
| 5,597,220 A | * | 1/1997 | Domenig et al. | 312/334.4 |
| 5,785,401 A | | 7/1998 | Bowyer et al. | |
| 5,842,759 A | | 12/1998 | Ferrari et al. | |
| D442,077 S | | 5/2001 | Crooks et al. | |

OTHER PUBLICATIONS

Two sheets of drawings: Applicants pending design application 29/160,355 Filed May 9, 2002.

Old Drawer Attachment, undated but in commercial use for more than one year before application filing date.

* cited by examiner

*Primary Examiner*—James O. Hansen

(57) ABSTRACT

A rear cabinet wall bracket is provided for use in a method of converting a side mount cabinet drawer to a cabinet drawer with under mount drawer guides. The bracket allows the under mount guide to be easily installed and adjusted for smooth drawer operation using the existing, pre-drilled holes in the rear cabinet wall. The method as described allows job site installers to convert side mount cabinet drawers to under mount cabinet drawers in a simple, fast and efficient manner.

7 Claims, 8 Drawing Sheets

BRACKET AND METHOD FOR CONVERTING SIDE MOUNT DRAWER TO UNDER MOUNT DRAWER

FIELD OF THE INVENTION

The invention herein pertains to the mounting of drawers in cabinets such as kitchen or bathrooms cabinets and particularly pertains to a method for converting drawers with side mount guides to under mount guides using a unique cabinet rear wall bracket.

DESCRIPTION OF THE PRIOR ART AND OBJECTIVES OF THE INVENTION

Kitchen and bathroom cabinets are usually partially assembled in a factory or shop and are then delivered to a house or other building job site for final assembly and installation. Most cabinet shops utilize side mount drawer guides which are relatively easy to install and inexpensive to purchase. Standard side mount drawer guides are available in a variety of designs and materials such as molded plastic, stamped metal and the like. While side mount drawer guides are satisfactory for most cabinets, under mount cabinet drawer guides are generally recognized as being of higher quality, having smoother performance and providing more stability and durability for the cabinet. Under mount drawer guides are generally more expensive and usually require the installer to use L-shaped metal, plastic or other brackets which are attached such as by screws or mounting lugs to the rear cabinet wall while the front end of the under mount drawer guides are affixed to the front or faceplate of the cabinet with screws or other fasteners.

Home buyers and remodelers in recent years have become increasingly discriminating and demand higher quality appliances, accessories, cabinets and other fixtures. Thus, cabinet installers are often faced with contractors and home purchasers that require the installation of under mount drawer guides for kitchen, bathroom, utility rooms and otherwise for a higher quality and better performing cabinet.

As partially assembled cabinets are usually delivered to a job site, the installer is faced with the labor intensive task of removing the pre-installed side mount drawer hardware including guides and installing under mount drawer guides. This requires the mounting of new brackets on the rear cabinet wall which usually entails drilling apertures in the rear cabinet wall to accommodate new under mount guide brackets. This is a difficult and tedious undertaking as the rear wall bracket for the new guides must be precisely placed or else the drawer will not slide properly, or will cause the guide to bend and wobble during operation. Often the rear wall is difficult to reach once partially installed requiring superior manual dexterity and skill to locate and attach rear wall brackets for the under mount guides.

Thus, with the problems and disadvantages of conventional side mount cabinet drawer guides and the difficulties encountered in removing and converting to under mount cabinet drawer guides, the present invention was conceived and one of its objectives is to provide an inexpensive rear cabinet wall bracket which will fit standard, pre-drilled apertures in the rear wall as used for conventional side mount rear wall brackets.

It is yet another objective of the present invention to provide a rear cabinet wall bracket for an under mount cabinet drawer guide which is simple to install and inexpensive to purchase.

It is yet another objective of the present invention to provide a method for utilizing a standard under mount cabinet drawer guide assembly which includes an under mount drawer guide attachment slidably connectable to the rear cabinet wall bracket of the invention.

It is a further objective of the present invention to provide a method for converting a cabinet drawer with a side mount drawer guide to an under mount drawer guide which requires little time and can be easily learned by inexperienced cabinet installers at the job site.

Various other objectives and advantages of the present invention will become apparent to those skilled in the art as a more detailed description is set forth below.

SUMMARY OF THE INVENTION

The aforesaid and other objectives are realized by providing a under mount drawer guide bracket which is formed from a polymeric material to accommodate conventional pre-drilled rear cabinet wall apertures to allow conversion of the cabinet drawers having side mount guides to under mount guides. The bracket includes a pair of mounting lugs which extend from the bracket rear face for positioning in existing rear cabinet wall apertures. The mounting lugs of the bracket are offset from the centerline to accommodate connection with the under mount guide. The face of the bracket includes a pair of opposing guide supports and a lateral channel with a stop for receiving a standard drawer guide attachment for slidable movement therealong.

The method of converting a cabinet drawer having a side mount drawer guides includes the steps of removing the side mount guides from the drawer, removing the cabinet rear wall bracket, attaching under mount drawer guides to the drawer and cabinet faceplate, attaching brackets with offset mounting lugs to the rear cabinet wall utilizing existing apertures, and affixing the under mount guides to the rear cabinet wall brackets to allow the guides to laterally move and adjust for proper alignment and smooth drawer operation.

DETAILED DESCRIPTION OF THE PREFERRED EMBODIMENTS AND OPERATION OF THE INVENTION

Figure 1:
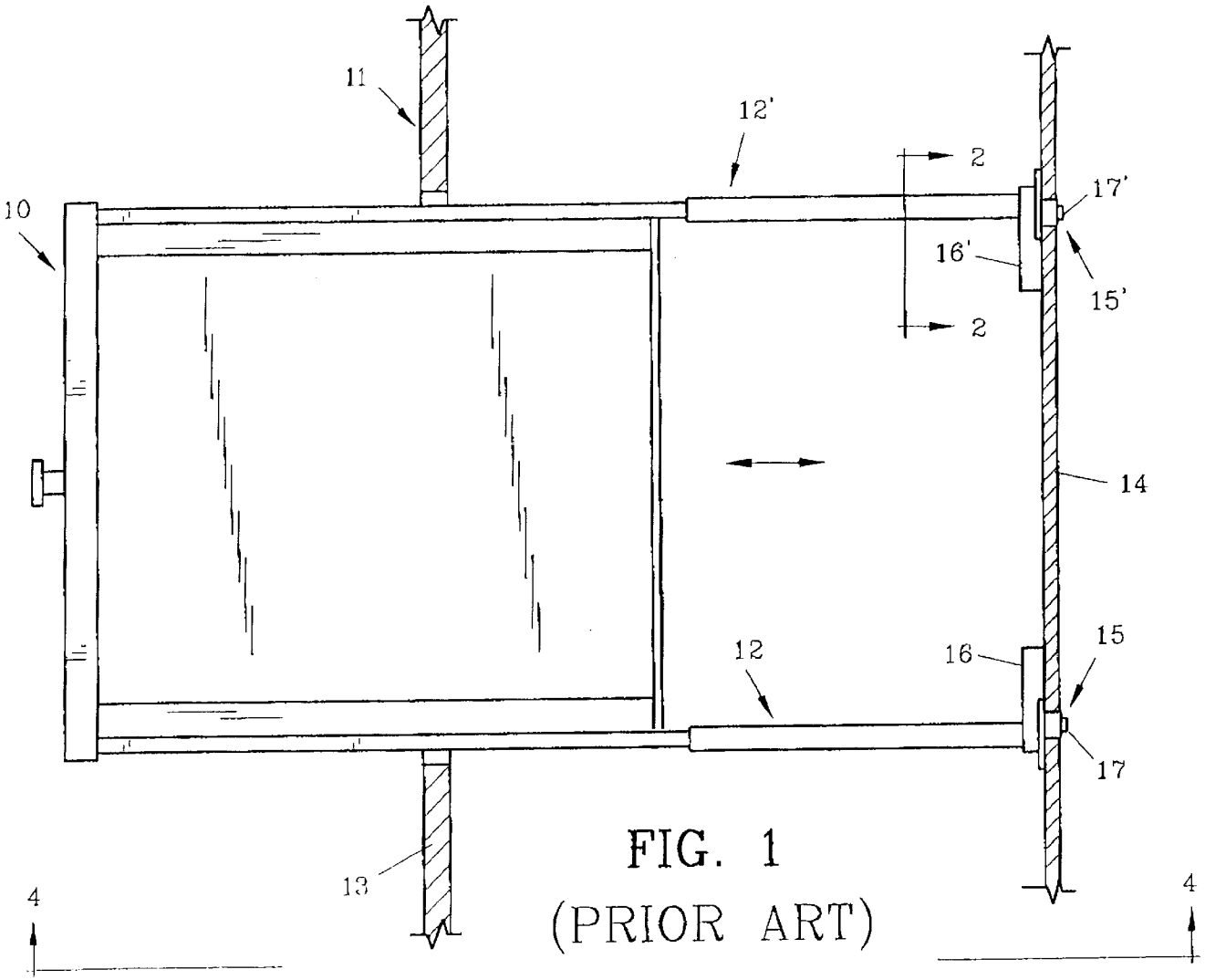
FIG. 1 (PRIOR ART)
FIG. 1 shows a top view of a typical cabinet drawer with standard side mount guides, the drawer withdrawn partially from the cabinet and the cabinet top cut-away for clarity.
Figure 11:
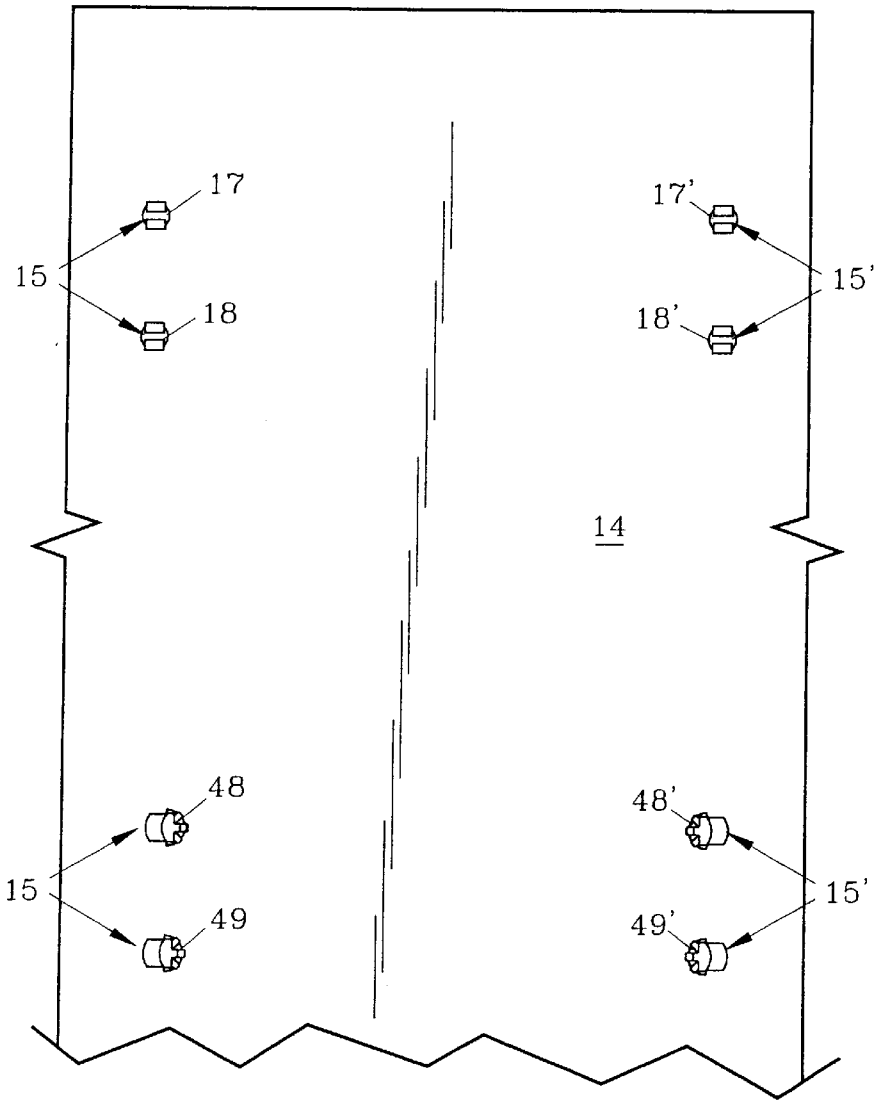
FIG. 11 illustrates a fragmented view of the outside surface of the rear wall of the cabinet as shown in FIG. 2 generally along lines 11—11.

For a better understanding of the invention and method of operation, turning now to the drawings, FIG. 1 shows conventional side mount cabinet drawer 10 positioned in cut-away cabinet 11 as may be found in a kitchen, bathroom or the like of a house. Drawer 10 is attached to right side drawer guide 12 and left side drawer guide 12' as are conventionally used in the trade. Cabinet 11 includes front wall or faceplate 13 and opposing rear cabinet wall 14 which is pre-drilled with a series of apertures 15, 15' as also seen in FIG. 11. In FIG. 11 cabinet 11 demonstrates apertures 15, 15' for two drawers in one column, however more or less drawers may be installed as required and may be arranged in a series of columns or rows, depending on the particular needs and cabinet configuration. For clarity herein, most Figure views only show one drawer 10.

Figure 2:
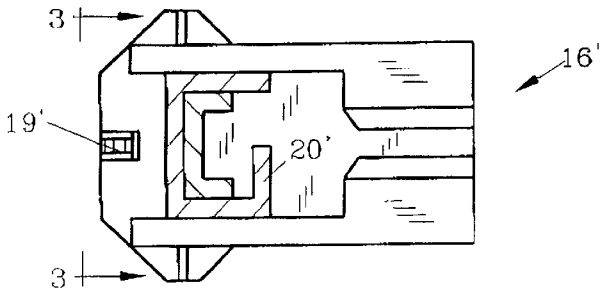
FIG. 2 (PRIOR ART)
FIG. 2 illustrates a view of the conventional side mount guide as seen along lines 2—2 of FIG. 1.
Figure 3:
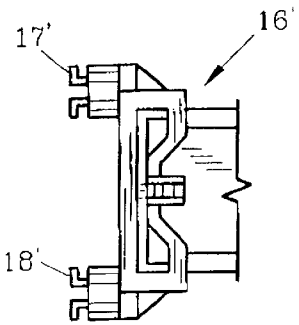
FIG. 3 (PRIOR ART)
FIG. 3 features an end view of the side mount rear cabinet wall bracket as seen in FIG. 2 along lines 3—3.
Figure 4:
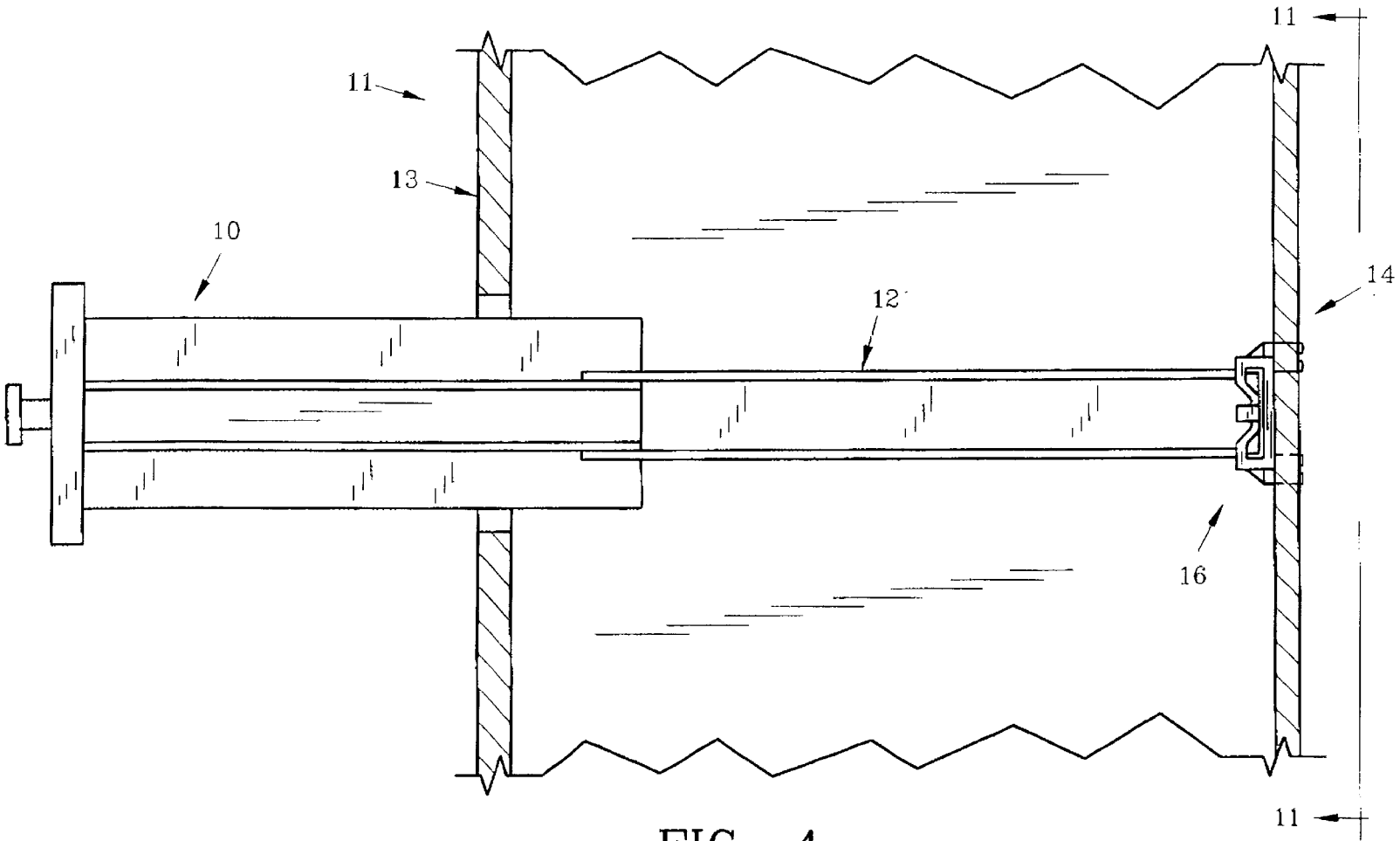
FIG. 4 (PRIOR ART)
FIG. 4 demonstrates a side elevational view of the cabinet drawer seen in FIG. 1 along lines 4—4 with the cabinet cut-away for clarity.

Standard cabinet side mount drawer guides 12, 12' are affixed to drawer 10 with conventional fasteners and require attachment and stabilization to rear cabinet wall 14. As seen in FIG. 1, brackets 16, 16' are used to anchor cabinet guides 12, 12' respectively to rear wall 14 with mounting lugs 17, 18, 17', 18'. In FIG. 4, drawer 10 is seen along lines 4—4 of FIG. 1 and to better understand the attachment of drawer guides 12, 12', FIG. 2 illustrates an enlarged view of bracket 16' as seen along lines 2—2 of FIG. 1. FIG. 3 illustrates an end view of bracket 16' as shown along lines 3—3 of FIG. 2 with mounting lugs 17', 18'. Tab 19' which is rigidly affixed to bracket 16' (FIG. 2) terminates the movement of adjustable slide member 20' shown therein. Thus, drawer 10 as shown in FIGS. 1 and 4 is conventionally mounted in cabinet 11 with side mount drawer guides 12, 12' which will function but is not entirely satisfactory and accordingly, under mount drawer guides are desired by many, such as drawer guides 30, 30' shown in FIGS. 5 and 7.

Figure 6:
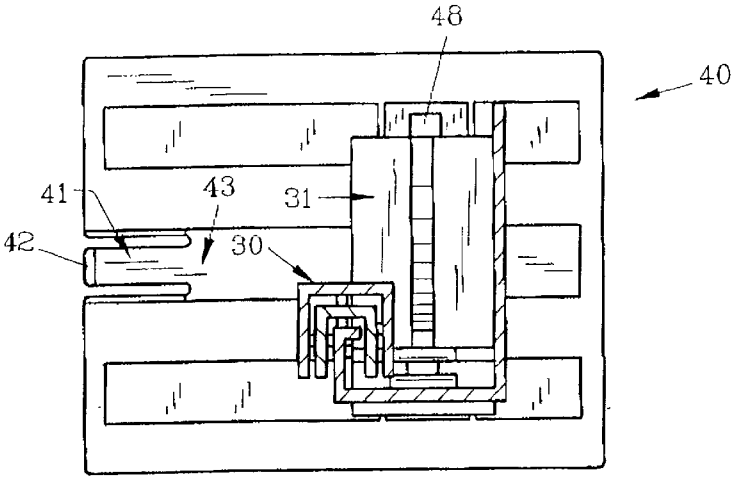
FIG. 6 illustrates a front view of the under mount guide bracket of the invention as seen along lines 6—6 of FIG. 5.
Figure 5:
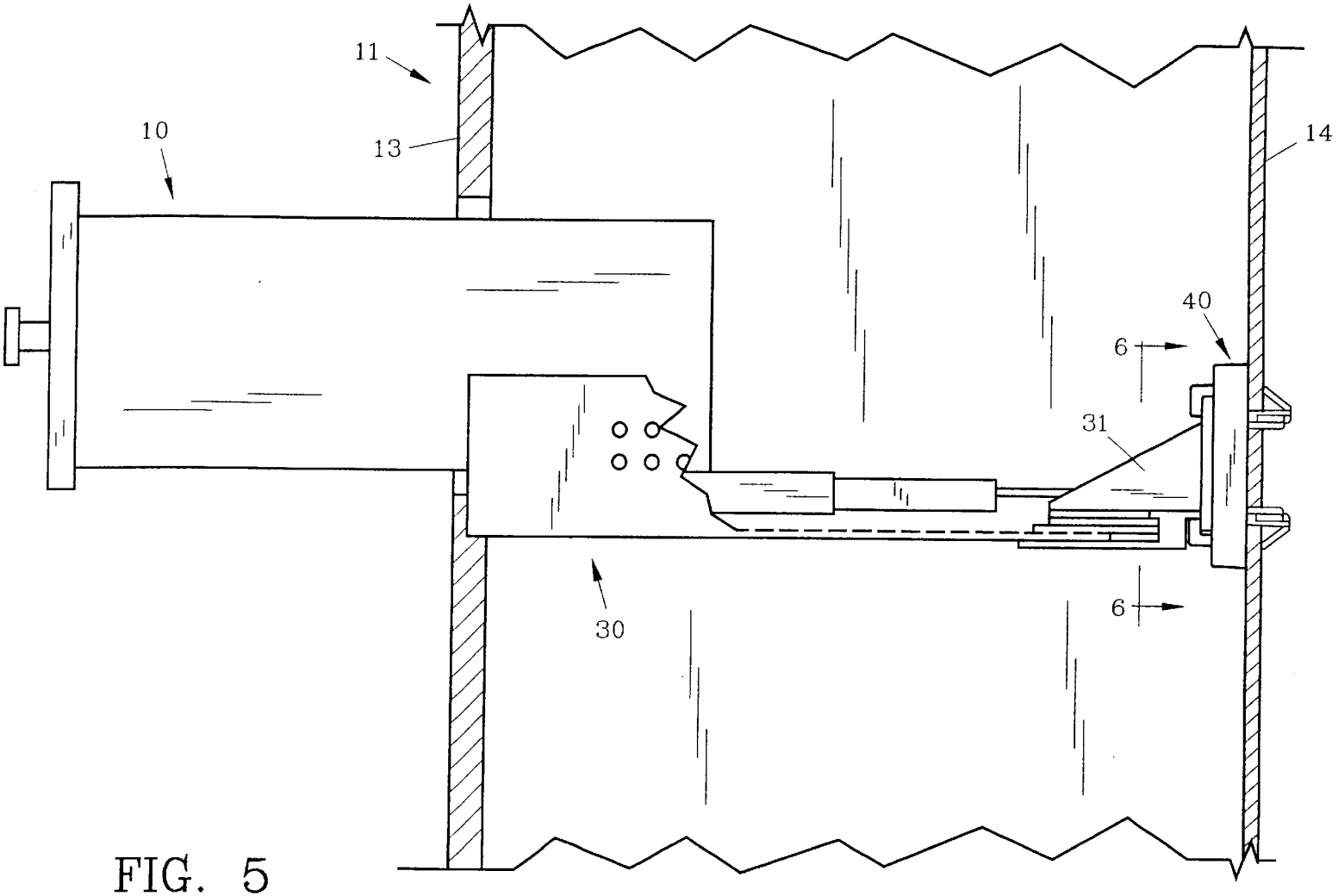
FIG. 5 shows a side elevational view of the cabinet and drawer converted with an under mount guide and an accommodating rear wall bracket.
Figure 7:
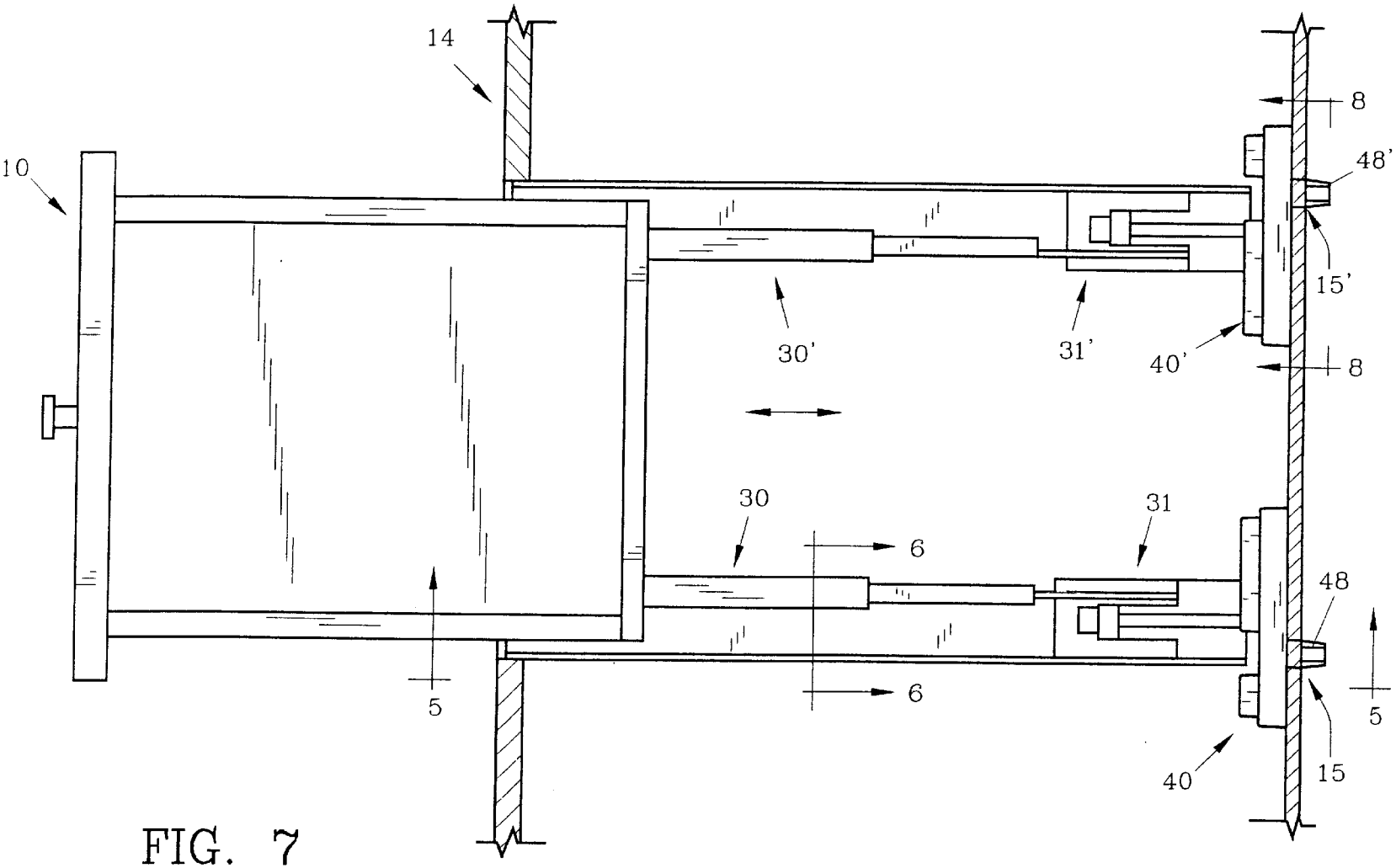
FIG. 7 depicts a top view of the drawer with under mount guides as attached as seen in FIG. 5.
Figure 9:
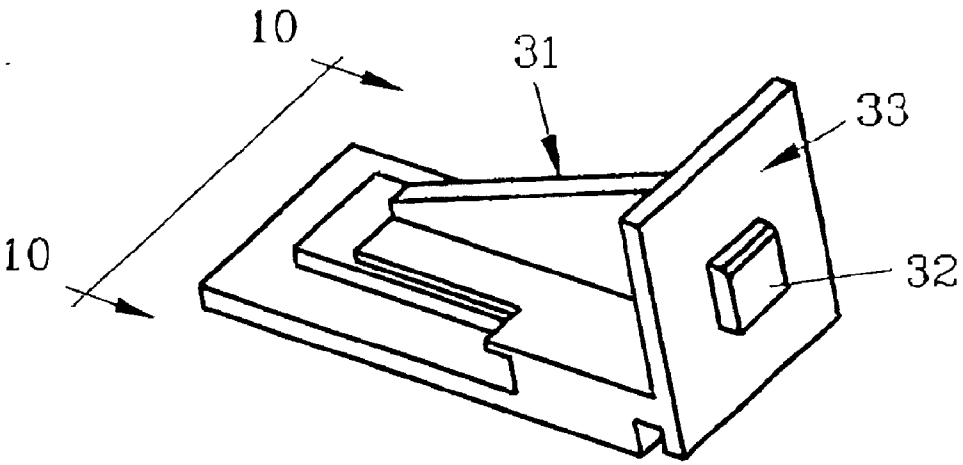
FIG. 9 (PRIOR ART)
FIG. 9 demonstrates a conventional drawer slide attachment member for connecting an under mount slide to a rear wall bracket.

Cabinet installers at a job site can easily convert a cabinet with side mount drawer guides such as cabinet 11 having pre-drilled apertures 15, 15' in rear wall 14 as shown in FIGS. 1 and 11. Side guides 12, 12' using brackets 16, 16' (if installed) can be removed and replaced with standard under mount drawer guides 30, 30' as shown in FIGS. 5 and 7. Preferred guide brackets 40, 40' are easily installed once brackets 16, 16' are removed from pre-drilled openings 15, 15' shown in FIG. 7 and thereafter connected to under mount guides 30, 30' utilizing standard guide attachments 31, 31'. Standard guide attachment 31' is slid into bracket 40 by depressing flexible stop tab 41 as seen in FIG. 6. Tip 42 of stop tab 41 extends normally from stop tab 41 about two millimeters. The height of tip 42 allows engagement with dog 32 on rear wall 33 of guide attachment 31 to terminate its lateral (right to left) movement as shown in FIGS. 6 and 9 as dog 32 slides within groove 43 in bracket 40. Thus, groove 43 allows for lateral adjustments of under mount drawer guide 30 as shown in FIG. 6 to provide convenience and ease of operation for drawer 10. By allowing guide 30 to move laterally within bracket 40, a more precise and smoother operation of drawer 10 is afforded.

While only right side rear wall bracket 40 and right under mount guide 30 are discussed herein, it is understood that opposite (left side) drawer guide and bracket would likewise operate and the method is discussed hereafter.

Figure 10:
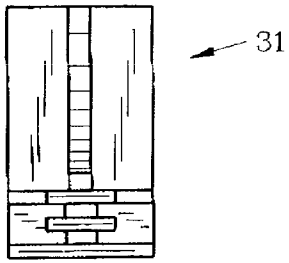
FIG. 10 (PRIOR ART)
FIG. 10 shows a front view of the attachment member as shown in FIG. 9 along lines 10—10.
Figure 8:
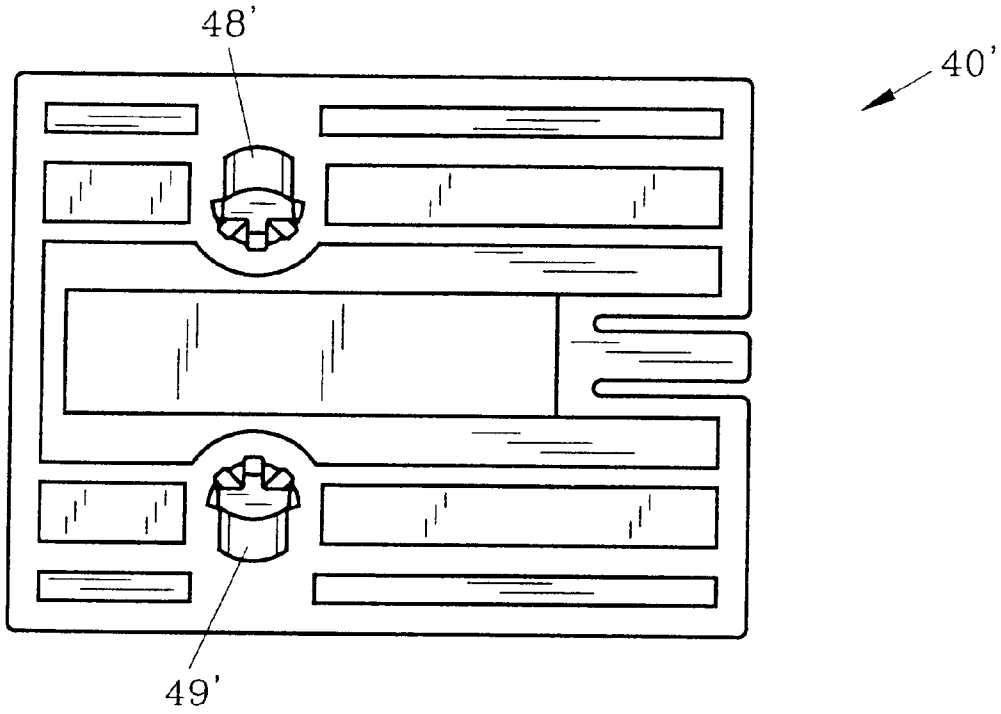
FIG. 8 pictures a rear view of the under mount guide bracket as seen generally along lines 8—8 of FIG. 7.

The preferred method of conversion from a side mount drawer guide such as guide 12' as shown in FIG. 1 to under mount drawer guide 30' as seen in FIG. 7 begins, for example with the conventional side mount drawer guides 12, 12' and rear wall brackets 16, 16' removed from cabinet 10. Next, with rear cabinet wall bracket 40' as seen in FIG. 8 is installed by urging rear lugs 48', 49' through apertures 15' as shown in FIG. 11. Right bracket 40 would next be installed by placing lugs 48, 49 through apertures 15, as also seen in FIG. 11. Under mount guides 30, 30' are then installed to drawer 10 and cabinet faceplate 13 as usual. Drawer guide attachments 31 (FIG. 10), 31' (FIG. 7) are then attached to drawer guides 30, 30' and to brackets 40, 40' respectively as hereinbefore described. The same method is repeated for all additional drawers as desired. Drawer guide attachments 31 (FIG. 10), 31' (FIG. 7) are then attached to drawer guides 30, 30' and to brackets 40, 40' respectively as hereinbefore described. The same method is repeated for all additional drawers as desired.

The illustrations and examples provided herein are for explanatory purposes and are not intended to limit the scope of the appended claims.

I claim:

1. A method of converting a cabinet drawer with a said mount guide to a drawer with an under mount guide utilizing a rear cabinet wall bracket having a pair of offset mounting lugs and a flexible stop tab, said wall bracket for receiving the under mount drawer guide comprising the steps of:

a) attaching the wall bracket to the cabinet rear wall by placing the mounting lugs in apertures of the rear cabinet wall;

b) removing the side mount guide from the drawer; and c) attaching an under mount drawer guide to the drawer and to the wall bracket by depressing the stop tab on the wall bracket.

2. The method of claim 1 wherein attaching the wall bracket to the rear cabinet wall comprises the step of sliding the mounting lugs through existing side mount bracket apertures in the rear cabinet wall.

3. The method of claim 1 wherein attaching an under mount drawer guide to the wall bracket comprises the step of slidably attaching the drawer guide to a guide attachment on the under mount drawer guide.

4. The method of claim 1 further comprising the step of removing a side mount drawer guide bracket from the rear cabinet wall before attaching the under mount rear wall guide bracket thereto.

5. A method of converting a cabinet drawer with a side mount cabinet drawer guide to a cabinet drawer with an under mount cabinet drawer guide utilizing a rear cabinet wall bracket having a pair of mounting lugs which are offset and are aligned to fit existing rear wall apertures, said wall bracket further defining a groove and a flexible stop tab, the method comprising the steps of:

a) removing the side mount drawer guides from the cabinet and drawer;

b) removing the side mount rear guide bracket from the cabinet rear wall apertures;

c) installing the under mount rear wall bracket into the existing rear wall apertures;

d) attaching an under mount drawer guide to the drawer and cabinet; and e) depressing the flexible stop tab on the wall bracket to connect the under mount guide to the rear wall bracket.

6. The method of claim 5 further comprising the step of allowing the under mount guide to adjust by movement within the rear wall bracket.

7. The method of claim 6 wherein allowing the under mount guide to adjust comprises the step of allowing a guide attachment positioned on the under mount drawer guide to move within the groove of the rear wall bracket.

* * * * *